United States Patent [19]

Sweeney et al.

[11] 4,207,078

[45] Jun. 10, 1980

[54] DIESEL FUEL CONTAINING MANGANESE TRICARBONYL AND OXYGENATED COMPOUNDS

[75] Inventors: William M. Sweeney; Kenneth L. Dille, both of Wappingers Falls, N.Y.

[73] Assignee: Texaco, Inc., White Plains, N.Y.

[21] Appl. No.: 32,990

[22] Filed: Apr. 25, 1979

[51] Int. Cl.[2] ..... C10L 1/18

[52] U.S. Cl. ..... 44/68; 44/53; 44/56; 44/77

[58] Field of Search ..... 44/68, 53, 56, 57, 77

[56] References Cited

U.S. PATENT DOCUMENTS

| | | | |
|---|---|---|---|
| 2,916,454 | 12/1959 | Bradley | 252/42.7 |
| 3,030,195 | 4/1962 | Ewan | 44/56 |
| 3,261,674 | 7/1966 | Condo | 44/68 |
| 3,410,670 | 11/1968 | Le Feur | 44/57 |
| 3,413,102 | 11/1968 | Andress, Jr. | 44/57 |
| 3,499,742 | 3/1970 | Kivelevich | 44/46 |
| 3,539,312 | 11/1970 | Eckert | 44/76 |

FOREIGN PATENT DOCUMENTS

| | | | |
|---|---|---|---|
| 1357620 | 4/1962 | France | 44/68 |

*Primary Examiner*—Winston A. Douglas
*Assistant Examiner*—S. V. Howard
*Attorney, Agent, or Firm*—Carl G. Ries; Robert A. Kulason; Henry W. Archer

[57] ABSTRACT

The amount of soot and invisible particulates emitted with the exhaust of engines run on diesel fuel is reduced by incorporating therein an additive consisting of a mixture of an oxygenated compound and an alkyl cyclopentadienyl manganese tricarbonyl.

Also disclosed is a method of operating a diesel engine using the fuel of the invention.

6 Claims, No Drawings

DIESEL FUEL CONTAINING MANGANESE TRICARBONYL AND OXYGENATED COMPOUNDS

BACKGROUND OF THE INVENTION

1. Field of the Invention

This invention relates to means and a process for reducing exhaust emissions of diesel fuels. More particularly, the invention is concerned with reducing the amount of invisible particulates in diesel engines exhaust emissions. The invention also relates to a method for operating a diesel engine in such a manner that there is produced a minimum of harmful obnoxious exhaust smoke by that engine.

Diesel fuels used in diesel engines give off in the exhaust of the engine particulates which recent tests indicate to be harmful pollutants. These particulates include not only those that exist as visible smoke when the diesel engine is overloaded or when the engine is worn or dirty, but also those that are invisible and emerge from partly loaded clean diesel engines. The Federal Environmental Protection Agency recently determined that diesel-powered automobiles emit unacceptably high levels of air pollution and must be reduced to ward off a possible health hazard.

Tests of 10 foreign and domestic cars showed many of the vehicles emitted particulate matter in amounts exceeding the agency's proposed standard for diesel-powered autos.

The proposed standards would allow six-tenths of a gram per mile for 1981 model cars, to be reduced to two-tenths of a gram per mile by the 1983 model year.

2. Description of the Prior Art

The prior art to which this invention relates is aware of U.S. Pat. Nos. 2,916,454; 3,410,670; 3,413,102; 3,539,312 and 3,499,742. These patents show smoke suppressants are commonly employed in or added to diesel fuel oils particularly when the diesel engine are to be operated in areas of high population density. In general, the most common smoke suppressants employed are the organic compounds of barium, particularly the barium carbonate overbased barium sulfonates, which are effective for substantially reducing the amount of smoke exhaust from a diesel engine. There are serious questions concerning the use of barium compounds as smoke suppressants, however. It is well known that some barium compounds are toxic to ingestion by human beings at high dosages. Calcium compounds, particularly calcium carbonate overbased calcium sulfonate, have been proposed to replace the barium carbonate overbased barium compounds in diesel fuels. However, the calcium carbonate overbased calcium sulfonates have not enjoyed any appreciable degree of use because of a number of serious disadvantages connected with their use. The last mentioned patent discloses a smoke inhibited diesel fuel composition comprising a hydrocarbon distillate fuel containing smoke suppressing amounts of a calcium alkyl-phenolate or sulfurized calcium alkylphenolate overbased with calcium 2-methoxyethoxide alone or with calcium hydroxide-2-methoxyethoxide. None of these patents is concerned with reducing the amount of both visible and invisible particulates emitted by diesel engines.

OBJECTS AND SUMMARY OF THE INVENTION

The main object of this invention is to provide diesel fuel compositions which emit, during use, reduced amounts of particulate combustion products.

Other objects and advantages of the invention will be apparent from the following description and the accompanying claims.

The present invention provides a hydrocarbon base diesel fuel composition containing a minor, particulate-reducing amount of an additive consisting of an oxygenated compound and an alkyl cyclopentadienyl manganese tricarbonyl. The method of the invention comprises supplying to and burning the fuel in a diesel engine.

In accordance with this invention there is blended with the diesel fuel from 0.01 to 1.5 weight percent of the oxygenated compound and 0.1 to 1.0 weight percent of the organometallic compound.

Whenever the expression "diesel fuel" is employed in the following description and claims, it is to be understood that it designates that hydrocarbon fraction which distills after kerosine. Its property requirements are those given on page 11-37 of the "Petroleum Processing Handbook", 1967 Edition. Generally, the diesel fuel will comprise a mixture of hydrocarbons boiling in the range of 350° to 700° F.

DISCLOSURE OF THE INVENTION

In accordance with the invention, the diesel fuel is modified by mixing therewith an oxygenated compound and an alkyl (preferably methyl) cyclopentadienyl manganese tricarbonyl (MMT). Suitable oxygenated compounds include aldehydes and ketones having from 3 to 16 carbon atoms such as propionaldehyde, acetone, cyclic ethers, butyl heptyl ketone and normal alcohols having from 3 to 16 carbon atoms in the chain and ethers containing from 2 to 10 carbon atoms such as tetrahydrofuran. In general enough of these compounds or mixtures thereof should be added to the diesel fuel to provide from 0.01 to 1.5 weight percent of oxygen in the combined form.

The following examples are set forth as representative and illustrative of the present invention.

EXAMPLE I

A diesel fuel containing tetrahydrofuran and MMT when burnt in a diesel engine gives reduced particulates compared to the neat diesel fuel.

EXAMPLE II

The procedure of Example I is repeated using acetone and MMT to give substantially similar results.

EXAMPLE III

The procedure of Example I is repeated using n-undecanol and MMT to give substantially similar results.

EXAMPLE IV

The procedure of Example I is repeated using propionaldehyde and MMT to give substantially similar results.

The effectiveness of the fuel and of the method of the invention are determined by burning untreated fuel and treated fuel in automotive diesel engines and running the exhaust into a dilution tube equipped with a Millipore filter which was weighed before and after combustion. Tests are run at 25 miles per hour road load, 40 mph road load, and 55 mph grade. The effect on particulate production of advanced, standard and retarded injection timing for each of the additives at each of the loads is noted.

What is claimed is:

1. A diesel engine fuel comprising a hydrocarbon base diesel fuel composition boiling in the range of 350° to 700° F. containing a particulate-suppressing mixture of 0.1 to 1.0 weight percent of an alkyl cyclopentadienyl manganese tricarbonyl with 0.01 to 1.5 weight percent of at least one oxygenated compound of the group of aldehydes and ketones having from 3 to 16 carbon; normal alcohols having from 3 to 16 carbon atoms in the chain; ethers having from 2 to 16 carbon atoms and mixtures thereof.

2. The fuel of claim 1, wherein said compound is methyl cyclopentadienyl manganese, tricarbonyl.

3. The fuel of claim 1, wherein said compound is sec. butyl heptyl ketone.

4. The fuel of claim 1, wherein said compound is tetrahydrofuran.

5. The fuel of claim 1, wherein said compound is acetone.

6. A method for reducing the exhaust particulate in the smoke of a diesel engine which comprises supplying to and burning in said engine a composition as defined in claim 1.

* * * * *